US008256746B2

(12) United States Patent
Gembolis et al.

(10) Patent No.: US 8,256,746 B2
(45) Date of Patent: Sep. 4, 2012

(54) INTEGRATED CROSS-FLOW RESERVOIR

(75) Inventors: Donald J. Gembolis, Toledo, OH (US); Albert F. Cella, Sylvania, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 857 days.

(21) Appl. No.: 12/297,947

(22) PCT Filed: Apr. 23, 2007

(86) PCT No.: PCT/US2007/067217

§ 371 (c)(1),
(2), (4) Date: Oct. 21, 2008

(87) PCT Pub. No.: WO2007/124484

PCT Pub. Date: Nov. 1, 2007

(65) Prior Publication Data

US 2009/0236761 A1 Sep. 24, 2009

Related U.S. Application Data

(60) Provisional application No. 60/793,943, filed on Apr. 21, 2006.

(51) Int. Cl.
*B01F 3/04* (2006.01)

(52) U.S. Cl. ..... 261/5; 261/152; 261/157; 165/119; 165/916

(58) Field of Classification Search ..... 261/3, 5, 261/152, 156, 157; 165/41, 51, 67, 119, 165/905, 916

See application file for complete search history.

(56) References Cited

U.S. PATENT DOCUMENTS

| | | | | |
|---|---|---|---|---|
| 2,219,101 | A | 10/1940 | Finwall | |
| 3,097,165 | A | 7/1963 | Kasten | |
| 3,463,317 | A | 8/1969 | Prier | |
| 4,295,964 | A * | 10/1981 | Preisler | 210/130 |
| 4,878,536 | A * | 11/1989 | Stenlund | 165/119 |
| 5,351,664 | A | 10/1994 | Rotter et al. | |
| 5,670,042 | A | 9/1997 | Clausen et al. | |
| 5,718,281 | A | 2/1998 | Bartalone et al. | |
| 5,992,174 | A * | 11/1999 | Mittelstrass | 62/474 |
| 6,216,772 | B1 * | 4/2001 | Johannesson | 165/119 |
| 6,752,200 | B2 * | 6/2004 | Holub | 165/41 |
| 6,929,739 | B2 * | 8/2005 | Pohl et al. | 210/90 |
| 6,935,413 | B2 * | 8/2005 | Kamishima et al. | 165/119 |
| 2003/0146147 | A1 * | 8/2003 | Pohl et al. | 210/435 |
| 2003/0234097 | A1 | 12/2003 | Holub | |
| 2004/0182566 | A1 * | 9/2004 | Jainek | 165/300 |
| 2006/0070724 | A1 * | 4/2006 | Yu et al. | 165/119 |
| 2006/0081361 | A1 * | 4/2006 | Gabbey et al. | 165/119 |

FOREIGN PATENT DOCUMENTS

| | | |
|---|---|---|
| DE | 20 2004 011911 | 1/2005 |
| DE | 20 2005 016332 | 12/2005 |
| EP | 0 632 246 | 1/1995 |
| EP | 0 867 670 | 9/1998 |

* cited by examiner

*Primary Examiner* — Charles Bushey
(74) *Attorney, Agent, or Firm* — Renner, Otto, Boisselle & Sklar, LLP

(57) ABSTRACT

A cross-flow reservoir has a uniquely integrated filter and heat exchanger, whereby the reservoir, filtration and cooling functions are all performed by a single unit and without connecting fittings and connecting hoses therebetween.

18 Claims, 2 Drawing Sheets

INTEGRATED CROSS-FLOW RESERVOIR

RELATED APPLICATIONS

This application is a national phase of International Application No. PCT/US2007/067217 filed Apr. 23, 2007 and published in the English language.

This application claims the benefit of U.S. Provisional Application No. 60/793,943 filed Apr. 21, 2006, which is hereby incorporated herein by reference.

FIELD OF THE INVENTION

The herein described invention relates generally to hydraulic systems and more particularly to hydraulic systems employing a hydraulic fluid reservoir and means for filtering and cooling the hydraulic fluid.

BACKGROUND OF THE INVENTION

Hydrostatic transmissions have many uses, including the propelling of vehicles, such as mowing machines. A typical hydrostatic transmission system includes a variable displacement main hydraulic pump connected in a closed hydraulic circuit with a fixed displacement hydraulic motor. For most applications, the pump is driven by a prime mover, such as an internal combustion engine or an electrical motor, at a certain speed in a certain direction. Changing the displacement of the main pump will change its output flow rate, which controls the speed of the motor. Pump outflow can be reversed, thus reversing the direction of the motor.

In some vehicles, such as zero-turn-radius mowers, separate hydraulic pumps and motors are used to independently drive separate wheels of an axle. By independently driving the wheels in opposite directions, for example, the vehicle can be made to turn with zero radius. Zero-turn-radius mowers are increasingly popular as the size and costs of such mowers decrease. As the size of such mowers decreases, however, the space available for the hydraulic components and/or the prime mover also decreases.

Hydrostatic transmissions generate heat as the hydraulic fluid is circulated between the pump and the motor. Friction between moving parts of the pump and/or motor also generates heat. Consequently, heat exchangers have been employed to cool the hydraulic fluid. In addition, filters have been used to filter the hydraulic fluid to remove contaminants that become entrained in the fluid during use.

In present day equipment, the heat exchanger, filter assembly and hydraulic fluid reservoir are provided as individual system components that are connected together by hydraulic hoses and fittings. These connections are potential leak paths, and the multiple components must be separately stocked.

SUMMARY OF THE INVENTION

The present invention provides a cross-flow reservoir having a uniquely integrated filter and heat exchanger, whereby the reservoir, filtration and cooling functions are all performed by a single unit and without connecting fittings and connecting hoses therebetween. In addition, a beneficial feature of the invention is that conventional radiator constructions can be easily configured to accommodate the filter and serve as a hydraulic fluid reservoir.

Accordingly, an integrated cross-flow reservoir comprising a housing, reservoir chambers at opposite ends of the housing. an inlet for supplying fluid to one of the reservoir chambers, an outlet for removing fluid from the other one of the reservoir chambers, a heat exchanger core with fluid channels connecting the reservoir chambers and cross-flow air passages through which air can flow to extract heat from fluid flowing through the fluid channels, and a filter element removably attached to the housing and housed within one of the reservoir chambers.

In a preferred embodiment, the filter element includes a ring of filter media having at least one open end, and a closure end cap to which the open end of the filter media ring is attached, the closure end cap having a closure portion for closing an opening through which the ring of filter media ring is inserted into the reservoir chamber. The closure end cap may have a flow passage through which fluid flows from the inlet to the interior of the filter media ring.

The filter element may have a bottom spaced inwardly from a bottom wall of the housing. The filter media ring may have a bottom opening that is closed by a bottom end cap, and the bottom end cap is provided with a bypass flow valve for allowing fluid to flow from the interior of the filter media ring to the reservoir chamber when the pressure differential across the filter media exceeds a prescribed amount.

In a preferred embodiment, a tubular filter support is attached to a top wall of the housing at an opening therein, and the closure end cap of the filter element is attached to the filter support. The filter element preferably is suspended from the filter support. A preferred closure end cap has an upper closure portion, a lower ring portion and an intermediate portion, the upper closure portion being externally threaded for screwing into an internally threaded portion of the tubular filter support, and the lower ring portion having an annular seal engaging an interior surface of the filter support. The inlet may include a passage through a sidewall of the filter support.

The heat exchanger core may be an aluminum finned plate-type heat exchanger. The heat exchanger core and reservoir chambers may be bounded by the housing walls, and the housing may have an overall rectilinear shape. The flow path from the filter media to the heat exchanger core preferably is uninhibited.

The invention also provides a filter element for use in a reservoir as set forth in any preceding claim.

Further features of the invention will become apparent from the following detailed description when considered in conjunction with the drawings.

DETAILED DESCRIPTION

The principles of the present invention can be applied in various types of hydraulic systems, as will be appreciated by those skilled in the art. The present invention, however, is particularly applicable to hydrostatic transmission systems for turf equipment. More generally, the principles of the invention may have applicability with other types of liquids where cooling and filtration are indicated.

Figure 1:
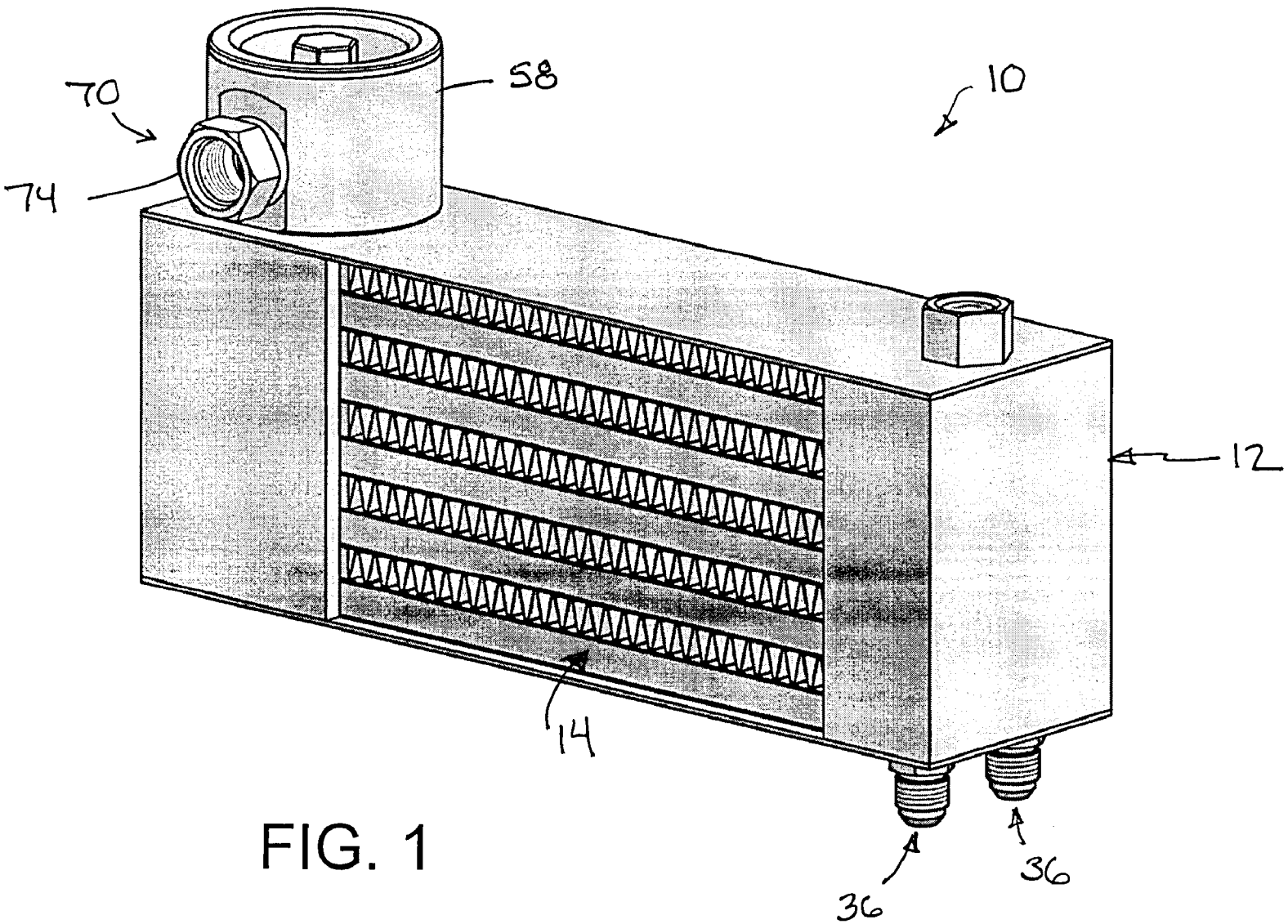
FIG. 1 is a perspective view of an exemplary integrated cross-flow reservoir according to the invention.
Figure 2:
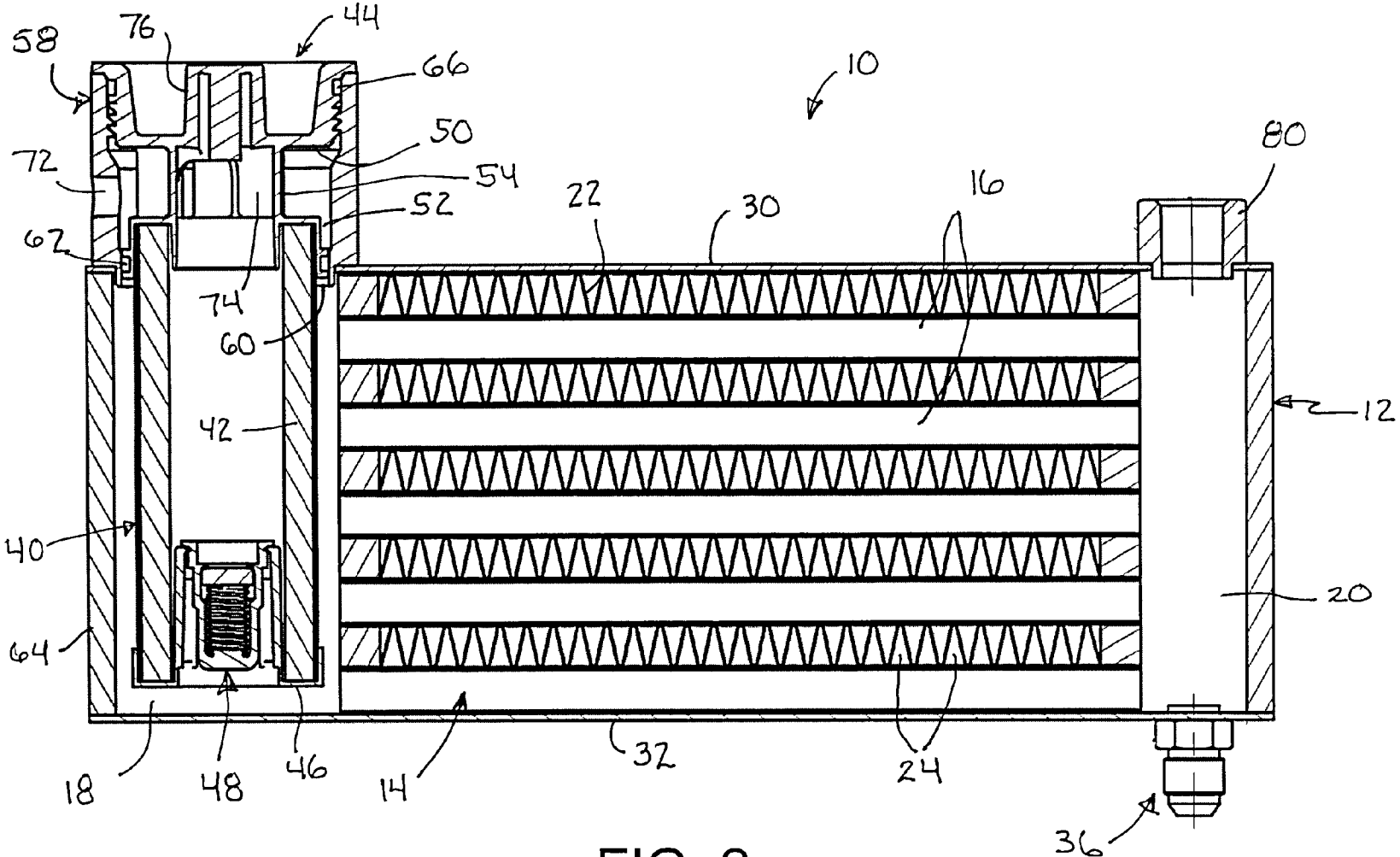
FIG. 2 is a cross-sectional view of the reservoir, taken substantially along the major center plane thereof.

Referring now to the drawings in detail and initially to FIGS. 1 and 2, an exemplary integrated cross-flow reservoir according to the invention is designated generally by reference number 10. The reservoir comprises a housing 12 containing a heat exchanger core 14 with fluid channels 16 connecting reservoir chambers 18 and 20 at opposite ends of the housing 12. The heat exchanger core 14 preferably is an aluminum finned plate-type heat exchanger, and the fins 22, which may zig-zag back and forth, are in thermally conductive contact with the fluid channels. The fins also form cross-flow air passages 24 through which air can flow to extract heat from the fins and fluid channels and in turn from hydraulic fluid flowing through the fluid channels from one reservoir chamber to the other.

As shown, the heat exchanger core and reservoir chambers are bounded by the housing walls, and the housing may have an overall rectilinear shape. The fluid channels are arranged side-by-side between top and bottom walls 30 and 32 of the housing and form the plurality of flow paths 16 for fluid to pass through the heat exchanger from one reservoir chamber to the other. The air passages 24 are generally disposed at right angles to the fluid channels and preferably the air is forced through the air passages as by means of a fan (not shown).

While the heat exchanger core can be air cooled as shown and described, the heat exchanger may be otherwise cooled, such as by water or refrigerant cooling. The air passages may function as or be replaced by water or refrigerant flow passages through which cooling water or refrigerant is circulated. Supply and return jackets, for example, may be provided on opposite sides of the housing for this purpose.

The heat exchanger is preferably fabricated from aluminum because of its light weight and high thermal conductivity, and the various parts may be brazed together using conventional fabricating techniques.

In the illustrated embodiment, hydraulic fluid flow is from the reservoir chamber 18 to the reservoir chamber 20, although flow in the reverse direction is also contemplated. The housing 12 at the lower end of the reservoir chamber 20 has outlet 36 formed by a tube fitting 38 to which a tube can be connected. In a typical hydraulic system, the tube connected to the outlet 36 would lead to the inlet of a hydraulic pump whereby operation of the pump would draw fluid from the reservoir chamber 20. This in turn would cause fluid to flow from the other reservoir chamber 18 through the heat exchanger 14 for cooling of the hydraulic fluid. As seen in FIG. 1, a second outlet 36 is provided, as may be desired to provide separate flow paths from the reservoir to the inlets of respective hydraulic pumps.

The other or inlet side reservoir chamber 18, in addition to functioning as a reservoir and inlet manifold to the heat exchanger 14, also functions as a filter chamber that contains therein a filter element 40. The filter element 40 comprises a ring of media 42 having at least one open end, and a closure cap 44 to which the open end of the filter media is adhesively or otherwise attached. The filter media ring may have an open bottom end that is closed by a bottom end cap 46 that is adhesively or otherwise attached to the bottom end of the filter media. As shown, the bottom end cap may be configured with a known bypass flow valve assembly 48 that allows fluid to bypass the fluid media when the pressure differential across the filter media exceeds a prescribed amount. The bypass flow valve preferably is set to open before the pressure differential would cause the filter media to collapse or otherwise fail.

The filter media may be of any suitable type. One particular type is a pleated filter made of one or more layers of micro-glass fiber material. Hydraulic fluid flowing from inside to outside the media may accumulate and flow or draw down the outside of the filter media until it joins with the hydraulic fluid residing in the bottom of the reservoir chamber.

The closure cap 44 has an upper closure portion 50, a lower ring portion 52 and an intermediate portion 54. The upper closure portion 50 is externally threaded for screwing into an internally threaded portion of a tubular filter support 58 mounted to the top wall 30 of the housing 12. The filter support has a lower end suitably configured for attachment to the top wall 30 at a hole in the top wall. As shown, the bottom of the tubular portion may have a reduced diameter neck portion 60 extending through the hole preferably with a close fit. The neck portion can facilitate attachment of the filter support to the top wall of the housing, which can be effected for example by brazing, welding or other means.

The neck portion 60 may also provide, as is preferred, a sealing surface for a deformable annular seal 62 that surrounds the lower ring portion 52 of the cap.

As illustrated, the filter element 40 is suspended from the filter support 58 when the upper closure portion 50 is screwed into the filter support. As is preferred, no additional means of support need be provided for the filter element. That is, no bottom support is needed to hold the filter element in place, nor is any bottom wall needed for sealing or otherwise coacting with the filter element for enabling its operation. The avoidance of a need for a bottom wall allows the bypass flow valve to be provided in the bottom end cap and to allow fluid to bypass flow to flow out through a central hole in the bottom end cap. In addition, the suspended filter element eliminates the need to add additional walls forming a filter chamber or a flow passage that communicates with an open bottom end of a filter element. Moreover, the entire support and sealing structure needed for the filter element can be provided by the filter support 58 that can be formed as a separate piece and then attached to an otherwise conventional heat exchanger configuration, aside from any needed sizing to provide the necessary space for accommodating the filter element. Thus, for example, a conventional heat exchanger configuration need only have an increased spacing between the outer end wall 64 of the housing 12 and the adjacent end of the heat exchanger core 14. As shown, the filter element can be positioned midway between the side wall and the adjacent end of the heat exchanger core. The reservoir chambers may be further sized to provide a desired hydraulic fluid volume capacity for a given application, with a typical volume for turf equipment being about one half gallon.

The foregoing also provides an uninhibited flow path from the filter media to the heat exchanger core, whereas in prior attempts it is believed the flow path between the filter media and inlets to the channels of the heat exchanger is constrained to a flow are less than the collective area of the fluid channels in the heat exchanger, thereby creating an unnecessary restriction on flow through the fluid reservoir 10, as may be undesirable under high flow conditions.

More generally and preferably, the filter support 58 provides for the support of the filter element 40 and the sealing surface for the filter element. The filter support 58 may also provide, as is preferred, the inlet 70 through which hydraulic fluid is returned to the reservoir, as from the outlet of one or more hydraulic motors in a hydraulic system. The inlet may be formed by a passage 72 in the sidewall of the filter support. The passage may be outfitted with a tube fitting 74 or other attachment device as shown in FIG. 1.

The passage 72 opens to the interior of the filter support at a location intermediate the upper closure portion of the closure cap and the lower ring (or disk) portion 52, and thus corresponding to the level of the intermediate portion 54. The intermediate portion includes one or more apertures for allowing fluid to flow from the passage 72 to and through an central passage in the lower disk portion 52 for flow into the interior of the filter ring. From there the fluid flows radially outwardly through the media and directly into the inlet side reservoir chamber. The filter ring may be supported at its outer diameter by a wire mesh as is commonly done in the industry.

The above mentioned annular seal 62 may be formed by any suitable means. In the illustrated embodiment, the seal is an O-ring that is retained in an annular groove at the outer diameter surface of the lower disk portion 52. The seal 62, as is preferred, seals against the inner diameter surface of the filter support tube.

Any suitable sealing mechanisms may be provided to seal the closure portion 50 of the closure cap to the filter support. As shown, the sealing mechanism may include an O-ring 66 retained in an annular groove in the outer diameter surface of the closure portion.

The closure cap 44 of the filter element 40 may be provided with suitable means to facilitate the removal of the filter element for replacement as needed. The closure cap may be provided with manually engaging recesses, although in the illustrated embodiment the closure cap is provided with a central hub 76 provided with external wrenching surfaces to enable rotation of the closure cap by use of a suitable wrench. As shown, the central hub may be hexagonal in cross-section for use with a standard socket wrench. The central hub may also be contained in a recess that opens to the upper end of the closure cap.

Although the filter element is illustrated as a screw-on element, other attachment mechanisms may also be employed. For instance, a clamp mechanism could be employed to hold the filter element to the filter support. By way of a specific example, the filter support could be externally threaded to receive a nut that can be used to clamp a flange on the upper closure portion to an end face of the filter support. Other attachment devices are also contemplated, although preferably they should provide for quick removal and attachment of the filter element.

As seen at the right in FIGS. 1 and 2, the reservoir may also be provided with an attachment device 80 for a breather cap (not shown) that may be of a conventional type employed in hydraulic systems. The attachment mechanism may be an internally threaded hex nut brazed to the top wall of the housing at a hole therein.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An integrated cross-flow reservoir comprising a housing, reservoir chambers at opposite ends of the housing. an inlet for supplying fluid to one of the reservoir chambers, an outlet for removing fluid from the other one of the reservoir chambers, a heat exchanger core with fluid channels connecting the reservoir chambers and cross-flow air passages through which air can flow to extract heat from fluid flowing through the fluid channels, and a filter element removably attached to the housing and housed within one of the reservoir chambers, wherein the filter element has a bottom opening that is closed by a bottom end cap, and the bottom end cap is provided with a bypass flow valve for allowing fluid to flow from an interior of the filter element to the reservoir chamber when the pressure differential across the filter element exceeds a prescribed amount.

2. A reservoir as set forth in claim 1, wherein the filter element includes a ring of filter media having at least one open end, and a closure end cap to which the open end of the filter media ring is attached, the closure end cap having a closure portion for closing an opening through which the filter media ring is inserted into the reservoir chamber.

3. A reservoir as set forth in claim 2, wherein the closure end cap has a flow passage through which fluid flows from the inlet to the interior of the filter media ring.

4. A reservoir as set forth in claim 1, wherein the filter element has a bottom spaced inwardly from a bottom wall of the housing.

5. A reservoir as set forth in claim 2, comprising a tubular filter support attached to a top wall of the housing at an opening therein, and the closure end cap of the filter element is attached to the filter support.

6. A reservoir as set forth in claim 5, wherein the filter element is suspended from the filter support.

7. A reservoir as set forth in claim 5, wherein the closure end cap has an upper closure portion, a lower ring portion and an intermediate portion, the upper closure portion being externally threaded for screwing into an internally threaded portion of the tubular filter support, and the lower ring portion having an annular seal engaging an interior surface of the filter support.

8. A reservoir as set forth in claim 5, wherein the filter support is attached to the top wall of the housing by brazing.

9. A reservoir as set forth in claim 5, wherein the inlet includes a passage through a sidewall of the filter support.

10. A reservoir as set forth in claim 1, wherein the heat exchanger core is an aluminum finned plate-type heat exchanger.

11. A reservoir as set forth in claim 1, wherein the heat exchanger core and reservoir chambers are bounded by walls of the housing, and the housing has an overall rectilinear shape.

12. A reservoir as set forth in claim 2, wherein the flow path from the filter media ring to the heat exchanger core is uninhibited.

13. A filter element for use in a reservoir as set forth in claim 1.

14. An integrated cross-flow reservoir comprising a housing, reservoir chambers at opposite ends of the housing, an inlet for supplying fluid to one of the reservoir chambers, an outlet for removing fluid from the other one of the reservoir chambers, a heat exchanger core with fluid channels connecting the reservoir chambers and cross-flow air passages through which air can flow to extract heat from fluid flowing through the fluid channels, a filter element removably attached to the housing and housed within one of the reservoir chambers, the filter element including a ring of filter media having at least one open end, and a closure end cap to which the open end of the filter media ring is attached, and the closure end cap has a closure portion for closing an opening through which the filter media ring is inserted into the reservoir chamber, and wherein a tubular filter support is attached to a top wall of the housing at an opening therein, and the closure end cap of the filter element is attached to the filter support.

15. A reservoir as set forth in claim 14, wherein the filter element is suspended from the filter support.

16. A reservoir as set forth in claim 14, wherein the closure end cap has an upper closure portion, a lower ring portion and an intermediate portion, the upper closure portion being externally threaded for screwing into an internally threaded portion of the tubular filter support, and the lower ring portion having an annular seal engaging an interior surface of the filter support.

17. A reservoir as set forth in claim 14, wherein the filter support is attached to the top wall of the housing by brazing.

18. A reservoir as set forth in claim 14, wherein the inlet includes a passage through a sidewall of the filter support.

* * * * *